US007109375B2

(12) United States Patent
Herdman et al.

(10) Patent No.: US 7,109,375 B2
(45) Date of Patent: Sep. 19, 2006

(54) ZINC AND ZINC ALLOY ELECTROPLATING ADDITIVES AND ELECTROPLATING METHODS

(76) Inventors: Roderick Dennis Herdman, 3 Cedar Crescent Kingsbury, Tamworth, Staffordshire (GB) B782JQ; Trevor Pearson, 8 Cricketers Meadow, Cradeley Heath (GB) B647HR; Anthony Rowan, 60 Park View, Sharnford, Hinckley, Leicestershire (GB) LE103PT ( * ) Notice: Subject to any disclaimer, the term of this patent is extended or adjusted under 35 U.S.C. 154(b) by 552 days.

(21) Appl. No.: 10/333,484

(22) PCT Filed: Jul. 11, 2001

(86) PCT No.: PCT/GB01/03117

§ 371 (c)(1),
(2), (4) Date: May 29, 2003

(87) PCT Pub. No.: WO02/08497

PCT Pub. Date: Jan. 31, 2002

(65) Prior Publication Data

US 2003/0192785 A1 Oct. 16, 2003

(30) Foreign Application Priority Data

Jul. 20, 2000 (GB) ..... 0017741.0
Dec. 21, 2000 (GB) ..... 0031252.0

(51) Int. Cl.

| | |
|---|---|
| ***C07C 335/00*** | (2006.01) |
| ***C07C 275/00*** | (2006.01) |
| ***C23C 16/00*** | (2006.01) |
| ***C25D 3/56*** | (2006.01) |
| ***C25D 3/22*** | (2006.01) |

(52) U.S. Cl. ..... 564/17; 564/26; 564/32; 564/47; 106/1.29; 205/244; 205/305; 205/311; 205/312; 205/313; 205/314

(58) Field of Classification Search ..... 564/17, 564/26, 32, 47; 106/1.29; 205/244, 305, 205/311, 312, 313, 314; 428/544
See application file for complete search history.

(56) References Cited

U.S. PATENT DOCUMENTS

| | | | | |
|---|---|---|---|---|
| 4,717,458 | A | 1/1988 | Martin et al. | 204/44.2 |
| 5,405,523 | A * | 4/1995 | Eckles | 205/245 |
| 5,435,898 | A * | 7/1995 | Commander et al. | 205/245 |
| 5,569,724 | A * | 10/1996 | Hendricks et al. | 525/432 |

FOREIGN PATENT DOCUMENTS

| | | |
|---|---|---|
| WO | WO 9931301 A1 * | 6/1999 |
| WO | WO 00/50669 | 8/2000 |

OTHER PUBLICATIONS

References A-C were cited on the International Search Report.*

* cited by examiner

*Primary Examiner*—Edna Wong
(74) *Attorney, Agent, or Firm*—Carmody & Torrance LLP

(57) ABSTRACT

An additive for an alkaline zinc or zinc alloy electroplating bath medium, the additive comprising a random co-polymer comprising the reaction product of: (i) one or more di-tertiary amines including an amide or thioamide functional group, and (ii) optionally, one or more saturated second di-tertiary amines and/or one or more second di-tertiary amines including an unsaturated moiety, with (iii) one or more saturated or unsaturated linking agents capable of reacting with said di-tertiary amines (i) and (ii), provided that, where all the linking agents are saturated, an unsaturated di-tertiary amine must he present. Preferably, the polymer has the general formula $n(2x+2y+zE_p)j$-.

29 Claims, No Drawings

ZINC AND ZINC ALLOY ELECTROPLATING ADDITIVES AND ELECTROPLATING METHODS

CROSS REFERENCE TO RELATED APPLICATIONS

This application is a National Stage application of International Application No. PCT/GB01/03117, filed Jul. 11, 2000.

BACKGROUND OF THE INVENTION

The present invention relates generally to improvements in the electrodeposition of zinc and zinc alloys from aqueous alkaline plating baths and to new additives for use in such electrodeposition processes.

Electrodeposition of zinc and zinc alloys, based for example on sodium zincate, has been known for many years. It is not possible to produce a commercially acceptable deposit from a simple sodium zincate electrolyte as the deposit is powdery and dendritic. For this reason, various additives have been proposed to provide improved deposition, such as cyanides (which have obvious environmental problems) and polymers of amines and epichiorohydrin which act as grain refining additives. These polymers are limited to usage in baths having relatively low concentrations of zinc because it is not possible to prevent uncontrolled deposition of zinc at higher metal concentrations. Also, electroplating processes using these additives tend to have poor cathode efficiency, a narrow bright range, a narrow operating window and tend to produce pitted and "burnt" deposits.

More recently, additives have been proposed which allow higher zinc concentrations to be used, which have significantly reduced burning and pitting and which allow a wider range of operating parameters. Further, the additives enable an excellent deposit distribution (that is, evenness of the deposit across the article being plated, irrespective of its shape in particular areas). This maximises the efficiency of zinc usage. These additives are based generally on polyquaternary amine compounds and are described in U.S. Pat. No. 5,435,898 and U.S. Pat. No. 5,405,523, which also provide further discussion of the prior art.

U.S. Pat. No. 5,435,898 describes polymers for use as additives in the electrodeposition of zinc and zinc alloys, the polymers having the general formula:

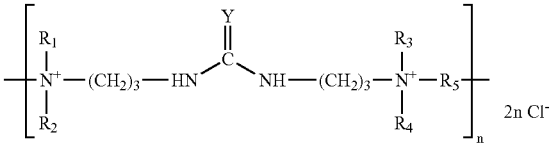

where $R_1$ to $R_4$ may be the same or different and are, inter alia, methyl, ethyl or isopropyl and Y may be S or O. $R_5$ is an ether linkage such as $(CH_2)_2$—O—$(CH_2)_2$.

U.S. Pat. No. 5,405,523 claims ureylene quaternary ammonium polymers in general as brightening agents in zinc alloy electroplating baths. The preferred and exemplified polymers include units of the general formula:

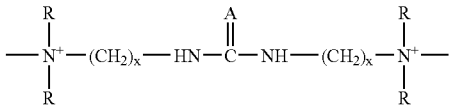

where A may be O, S or N and R may be, inter alia, methyl, ethyl or isopropyl. In the preferred polymers, these units are linked by units derived from, for example a bis(2-haloethyl) ether, a (halomethyl) oxirane or a 2, 2'-(ethylenedioxy)-diethylhalide. Ethylene dihalides such as ethylene dichloride and ethylene dibromide are also suggested but not exemplified.

Further known additives are polycationic compositions based on polymerisation of dimethyl-diallyl ammonium chloride with sulphur dioxide as described in DE 19,509,713.

However, the overall cathodic efficiency of these processes can be low and the resultant deposits may be unsatisfactory in terms of brightness and levelling.

A recent patent application PCT/GB00/00592 provides improved polymers for use as additives in the electrodeposition of zinc and zinc alloys. In particular, this application suggests that by avoiding an ether-type linkage such as $R_5$ in the prior art above, a brighter deposit can be obtained to which it is also easier subsequently to apply conversion coatings.

Another very desirable feature of the electrodeposition of zinc is that the adhesion of the deposit to the substrate must be excellent. This is because zinc has a very low permeability for hydrogen. Thus hydrogen, which is absorbed into the substrate (particularly steel) during the deposition process, may subsequently accumulate at the interface between the substrate and coating and give rise to the formation of "blisters". Such blistering can occur when using the additives in accordance with the above prior art.

WO 00/14305 describes polymers of the general formula:

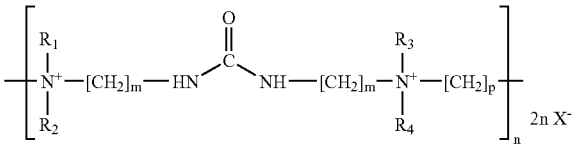

The applicants have investigated polymers of this type as plating additives and have found that that the overall cathode efficiency remains low and the resistance of the resulting deposit to post-plate blistering is still relatively poor.

DETAILED DESCRIPTION OF THE PREFERRED EMBODIMENTS

The present invention is thus concerned with electrodeposition on a variety of electrically conducting substrates in a medium which seeks to provide improved cathode efficiency and/or improved brightness and levelling, and further to provide coatings that are resistant to post-plate "blistering". Suitable substrates include iron and ferrous-based substrates (including both iron alloys and steels), aluminium and its alloys, magnesium and its alloys, copper and its alloys, nickel and its alloys, and zinc and its alloys. Aluminium and its alloys and ferrous-based substrates are particularly preferred substrates, with steels being most preferred.

According to a first aspect of the invention, there is provided an additive for an alkaline zinc or zinc alloy electroplating bath medium, the additive comprising a random co-polymer comprising:

(A) a reaction product of:

(i) one or more di-tertiary amines including an amide or thioamide functional group, and (ii) one or more second di-tertiary amines including an unsaturated moiety, with (iii) one or more first linking agents capable of reacting with said amines (i) and (ii);

or (B) a reaction product of:

(iv) one or more di-tertiary amines including an amide or thioamide functional group and, optionally, (v) one or more saturated second di-tertiary amines and/or one or more second di-tertiary amines including an unsaturated moiety, with (vi) one or more second linking agents capable of reacting with said amines (iv) and (v) and including an unsaturated moiety.

In an alternative definition according to a second aspect of the invention, there is provided an additive for an alkaline zinc or zinc alloy electroplating bath medium, the additive comprising a random co-polymer comprising the reaction product of:

(i) one or more di-tertiary amines including an amide or thioamide functional group, and (ii) optionally, one or more saturated second di-tertiary amines and/or one or more second di-tertiary amines including an unsaturated moiety, with (iii) one or more saturated or unsaturated linking agents capable of reacting with said di-tertiary amines (i) and (ii), provided that, where all the linking agents are saturated, an unsaturated di-tertiary amine must be present.

In this specification, unless the context requires otherwise, "unsaturated" compounds include aromatic compounds and "lower alkyl" means $C_1$–$C_6$ alkyl.

In one embodiment of the first aspect of the invention, the first linking agent may also include an unsaturated moiety.

Whilst it is preferable to use a single chemical for each of the respective components defined above, mixtures may be used to achieve desired properties of the product provided that the product includes the required unsaturation.

In a particularly preferred embodiment the di-tertiary amine containing an amide or thioamide functional group has the general formula:

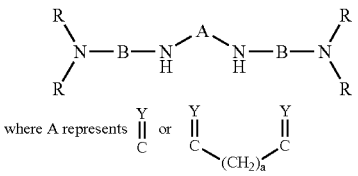

(1)

and Y═O or S, a is an integer from 2 to 6, B represents a lower alkyl group and R represents a methyl, ethyl, isopropyl, n-propyl or hydroxyethyl group and each R may be the same or different. R is preferably methyl, B is preferably a $C_2$–$C_4$ alkyl group and most preferably is $C_3$.

Examples of this type of di-tertiary amine are N,N'-bis-[2-diethylaminoethyl] urea and N,N'-bis-[3-dimethylamino)propyl]urea, with the N,N'-bis-[3-(dimethylamino)propyl] urea being particularly preferred.

In another preferred embodiment of the first and second aspects of the invention the second di-tertiary amine including the unsaturated moiety has the general formula;

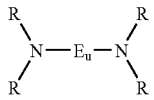

(2)

where R is as defined above and $E_u$ represents the unsaturated moiety. Preferably, $E_u$ is selected from groups of the general formula

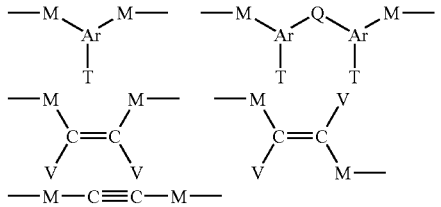

where M may be absent or is a straight chain, branched or cyclic $C_1$–$C_8$ alkyl group and each M may be the same or different, V may be hydrogen or a lower alkyl group and each V may be the same or different, Ar represents an aromatic or hetero-aromatic nucleus, T may be absent or represents one or more substituents on the aryl nucleus and Q may be absent or is a link group selected from ether, thioether, carbonyl, thione, secondary, tertiary or quaternary amine, sulfone or sulfoxide, or a straight chain, branched or cyclic $C_1$–$C_{12}$ alkyl group which may optionally contain in the alkyl chain one or more groups selected from ether, thioether, carbonyl, thione, alcohol, thiol, secondary, tertiary or quaternary amine, sulfone and sulfoxide.

When $E_u$ includes an aromatic nucleus, it is particularly preferred that $E_u$ is selected from groups of the general formula

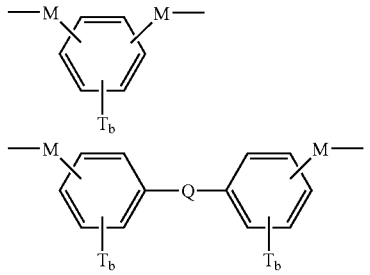

where M, Q and T are as defined above and b represents the number of substituents T. (Substituents not specifically defined as T, M or Q are hydrogen). The location of the substituents -M- on the aromatic (or hetero-aromatic) nucleus is preferably selected to give the sterically most advantageous substitution. For a 6-membered aromatic nucleus, the -M- groups may be ortho-, meta- or para-, but para-orientation is preferred.

When Ar is hetero-aromatic, Ar preferably represents a 5 or 6 membered aromatic nucleus including one or more O and/or S and/or N atoms.

In preferred embodiments of the invention T may be for example, lower alkyl, hydroxy, alkoxy, primary or secondary amine, primary or secondary alkylamine, carboxylic acid or halogen. In practice the larger aryl di-tertiary amines are less useful due to the poor solubility of the product in aqueous media, but solvents may be used to achieve solubility in the reaction mixture.

These types of amine introduce the unsaturated function into the main polymer chain. Preferred examples of these di-tertiary amines are N,N,N'N'-tetramethyl-1,4-phenylenediamine, 4,4'-methylenebis-N,N-dimethylbenzeneamine, N,N,N',N'-tetramethyl-3,3'-sulfonylbisbenzeneamine and 2,6-bis-[(dimethylamino)methyl]-4-methylanisole, with N,N,N',N'-tetramethyl-1,4-phenylenediamine being particularly preferred.

In a further embodiment of the invention, the second di-tertiary amine including the unsaturated moiety has the general formula (4)

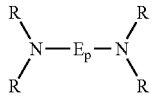

where R is as defined above and $E_p$ has the general formula (4a)

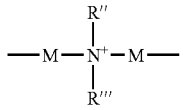

or (4b)

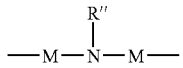

where M is as defined above, R''' may be the same as R'' or may represent a straight chain, branched or cyclic $C_1$–$C_8$ alkyl group, and R'' may be selected from

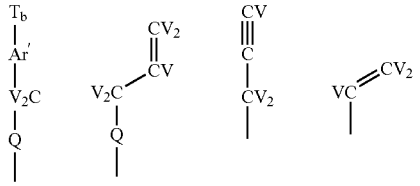

where V, T and b are as defined above, Q may be absent or is as defined above and Ar' represents a 5 or 6 membered aromatic or hetero-aromatic nucleus. The group Q can be absent when, for example, R'' is derived from allyl chloride but can be present when, for example, R'' is derived from allyl glycidyl ether. When Ar' is hetero-aromatic, Ar' preferably represents a 5 or 6 membered aromatic nucleus including one or more O and/or S and/or N atoms.

In these embodiments of the invention the unsaturated function is attached pendant to the main polymer chain. This type of group in the polymer is achieved by providing that the second di-tertiary amine which is used also contains a secondary amine function. If the total molar amount of linking agent is not in excess of the total molar amount of di-tertiary amine(s) used, then the secondary amine function in the molecule does not participate in the formation of the polymer chain because the linking agent reacts with the tertiary amine in preference to the secondary amine. After the formation of the polymer chain is completed, this secondary amine group can then be reacted with a suitable unsaturated compound to produce a pendant unsaturated group $E_p$.

In accordance with said further embodiment of the invention above and in a variation of the first and second aspects of the invention, a third aspect of the invention provides an additive for an alkaline zinc or zinc alloy electroplating bath medium, the additive comprising a random co-polymer comprising the reaction product of:

(A) a pre-polymer comprising the reaction product of:

(i) one or more di-tertiary amines including an amide or thioamide functional group, and (ii) one or more second di-tertiary amines including a secondary amine group, with (iii) one or more linking agents capable of reacting with said amines (i) and (ii), with (B) an unsaturated compound capable of reacting with said secondary amine group, thereby to produce a pendant unsaturated group.

Thus, the moiety in the random co-polymer comprising the reaction product of said secondary amine and the unsaturated compound will most preferably be of the formula:

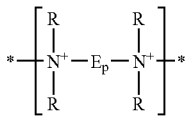

where $E_p$ and R are as defined above.

When the linking group does not contain an unsaturated function and the required unsaturation is provided (at least in part) by the di-tertiary amines of formula (4a) or (4b), the molar ratio r of (R''+R''') to the secondary amine in the polymer chain may be $0<r\leqq 2$. Normally the ratio will be in the range $0.5\leqq r\leqq 1.5$. Thus, the secondary amine functions initially present in the polymer may be converted to a mixture of tertiary and quaternary amine groups and some of the secondary amine groups may remain unreacted.

Examples of formation of this type of group are given by the use of N,N,N'',N''-tetramethyldiethylenetriamine (as the di-tertiary amine also including a secondary amine function) further reacted with benzyl chloride, 3,3'-imino-bis-(N,N-dimethylaminopropylamine) (as the di-tertiary amine also including a secondary amine function) further reacted with methallyl chloride, 3,3'-imino-bis-(N,N-dimethylaminopropylamine) (as the di-tertiary amine also including a secondary amine function) further reacted with allyl glycidyl ether and N,N,N'',N''-tetramethyldiethylenetriamine (as the di-tertiary amine also including a secondary amine function) further reacted with allychloride, with 3,3'-imino-bis-(N,N-dimethylaminopropylamine) as the second di-tertiary amine further reacted with allyl glycidyl ether being most preferred.

In further embodiments of the invention the second di-tertiary amine where saturated has the general formula

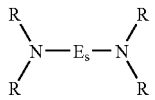

(3)

where R is as defined above and $E_s$ represents a straight chain, branched or cyclic $C_1$–$C_8$ alkyl group which may optionally contain in the alkyl chain one or more groups selected from: ether, thioether, carbonyl, thione, alcohol, thiol, secondary, tertiary or quaternary amine, sulfone and sulfoxide. Where $E_s$ includes a tertiary or quaternary amine, $E_s$ may also be represented by the general formula:

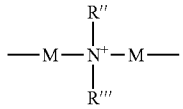

(3a)

or

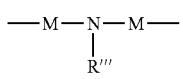

(3b)

where M is as defined above and R''' represents a straight chain, branched or cyclic $C_1$ to $C_8$ alkyl group. Groups of formula (3a) or (3b) may be formed by providing that the optional second di-tertiary amine also includes a secondary amine function. If the total molar amount of linking agent is not in excess of the total molar amount of di-tertiary amine(s) used, then the secondary amine function in the optional second di-tertiary amine does not participate in the formation of the polymer chain because the linking agent reacts with the tertiary amine in preference to the secondary amine. After the formation of the polymer chain is completed, this secondary amine group can then be reacted with suitable precursors of R''' to produce groups of formulas (3a) and (3b). Depending on the amount of R''' precursor used, the secondary amine functions may be converted into a tertiary amine (formula 3a) and/or a quaternary amine (formula 3b) and some of the secondary amine may be unreacted.

Preferred examples of the optional second di-tertiary amine, when saturated, are N,N,N',N'-tetramethyl-1,6-diaminohexane, bis-(2-dimethylaminoethyl) ether and 3,3'-imino-bis-(N,N-dimethylaminopropyl amine).

A particularly preferred optional second di-tertiary amine is N,N,N',N'-tetramethyl-1,6-diaminohexane. Alternatively, the optional second di-tertiary amine may be a cyclic di-tertiary amine such as N,N'-dimethylpiperazine or triethylene diamine.

In another preferred embodiment of the invention the first and/or second linking agent is unsaturated and has the general formula:

$$X\text{-}G_u\text{-}X \quad (5)$$

where X is Cl, Br or I and $G_u$ represents an unsaturated moiety.

Preferably, $G_u$ is selected from

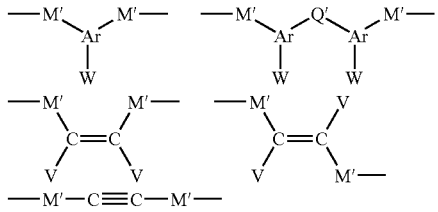

where V represents H or a lower alkyl group, M' is a straight chain, branched or cyclic $C_1$–$C_8$ alkyl group and each M' may be the same or different, Ar represents a 5 or 6 membered aromatic nucleus or a 5 or 6 membered hetero-aromatic nucleus including one or more hetero-atoms selected from S and O, W may be absent or represents one or more substituents on the aromatic or hetero-aromatic nucleus and Q' may be absent or is a link group selected from ether, thioether, carbonyl, thione, sulfone or sulfoxide or a straight chain, branched or cyclic $C_1$–$C_8$ alkyl group which may optionally contain in the alkyl chain one or more groups selected from ether, thioether, carbonyl, thione, alcohol, thiol, sulfone and sulfoxide.

The location of the substituents -M'- on the aromatic nucleus is preferably selected to give the sterically most favoured substitution. For a 6-membered aromatic nucleus, the -M'- groups may be ortho-, meta- or para-, but para-orientation is preferred.

W may, for example, be lower alkyl, hydroxyl, alkoxy, carboxylic acid or halogen. In practice the larger aryl compounds are less useful due to the poor solubility of the product in aqueous media, but solvents may be used to make them soluble in the reaction mixture. Examples of this type of compound are 1,4-dichlorobutene, 1,4-dichlorobutyne and α,α'-dichloro-p-xylene, with 1,4-dichlorobutene being most preferred.

When $G_u$ includes an aromatic nucleus, it is preferred that $G_u$ is selected from

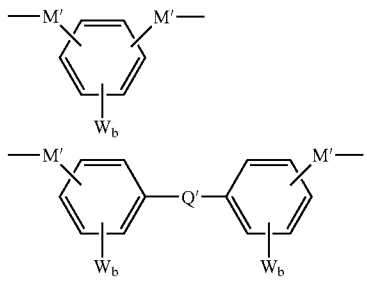

where W, Q' and M' are as defined above and b represents the number of substituents W. (Substituents not specifically defined as W, Q' or M' are hydrogen).

In an alternative preferred embodiment the first linking agent is saturated and has the general formula $$X\text{-}G_s\text{-}X \quad (6)$$

where X represents Cl, Br or I and $G_s$ represents a straight chain, branched or cyclic $C_1$–$C_8$ alkyl group which may optionally contain in the alkyl chain one or more groups selected from ether, thioether, carbonyl, thione, alcohol, thiol, sulfone, or sulfoxide. Preferred examples of these compounds are 1,3-dichlorobutane, 1,4-dichlorobutane, 1,5-dichloropentane, 1,6-dibromohexane and bis-2-chloroethyl ether. 1,4-dichlorobutat and bis-2-chloroethyl ether are particularly preferred.

Alternatively, the first linking agent may be a halomethyloxirane compound, for example epichlorohydrin.

In an especially preferred embodiment the random copolymer has the general formula

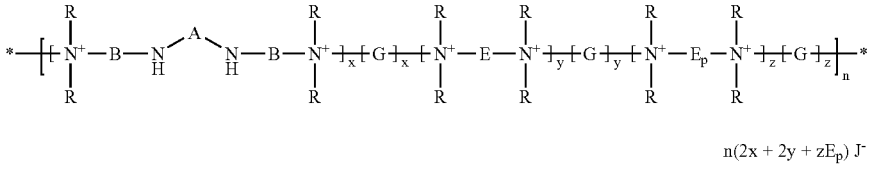

where $0<x\leqq 1$, $0\leqq y<1$, $0\leqq z<1$ and $x+y+z=1$, n is at least 2, A, B and R are as defined above, and J is a counter ion. G represents $G_u$ or $G_s$ as defined above, E represents $E_u$ or $E_s$ as defined above and $E_p$ is as defined above, provided that if neither $E_u$ nor $E_p$ is present, $G_u$ must be present. Thus x, y and z represent the mole fractions of the respective di-tertiary amines. The absolute value of n is not specified as the polymer of the invention will normally comprise polymer molecules of a range of molecular weights. For individual polymer molecules, n will generally be at least 4 to 20 and may be as high as 100 or more.

To achieve the higher values of n the molar ratio of the total di-tertiary amines to the linking agents may be in the range 5:4 to 4:5, but is most preferably about 1:1.

Also, the molar ratio in the polymer of the respective di-tertiary amine groups may be selected as desired in order to influence the properties of the electrodeposited coating produced by the products of the invention. Where the linking agent is unsaturated, only the di-tertiary amine with the amide functional group is essential and so the optional second di-tertiary amine may be absent. When the optional second di-tertiary amine is present, it may be unsaturated or saturated. Preferably, the molar ratio in the polymer of the di-tertiary amine with the amide functional group to the optional second di-tertiary amine is from 40:60 to 80:20 and most preferably from 50:50 to 70:30. In the case where only a saturated linking agent is present, a second di-tertiary amine which includes an unsaturated moiety must be present. Preferably, the molar ratio in the polymer of the di-tertiary amine with the amide functional group to the second di-tertiary amine with an unsaturated moiety is from 40:60 to 80:20 and most preferably from 50:50 to 70:30. The polymer of the invention may include only saturated linking agents, only unsaturated linking agents or both saturated and unsaturated linking agents but it is essential that unsaturation is provided by at least one of (a) the linking agent and (b) a second di-tertiary amine.

The minimum degree of unsaturation which is desirable in the polymers of the invention in order to achieve the desired properties will vary depending on the type of unsaturated group(s) in the polymer (e.g. aromatic vs aliphatic) and the manner in which the unsaturated groups are present (e.g. in the main polymer chain vs pendant groups).

Generally, if M(A1) is defined as the mole fraction of the di-tertiary amines including the amide functional group, M(A2) is defined as the mole fraction of the second di-tertiary amine(s) and M(G) is defined as the mole fraction of the linking agents and M(A2) can be expressed as $M(A2)=M(E_u)+M(E_s)+M(E_p)$, M(G) can be expressed as $M(G)=M(G_u)+M(G_s)$ and where $M(A1)+M(A2)+M(G)=1$, then the molar degree of unsaturation M(U) in the polymer of the invention can be expressed as $$M(U)=M(E_u)+M(E_p)+M(G_u)$$

Thus, in the polymers of the invention $0<M(U)<1$, and higher values of M(U) indicate a higher unsaturated content.

Preferably, M(U) is at least 0.05, more especially M(U) is in the range of 0.1 to 0.5 and particularly preferably M(U) is in the range 0.15 to 0.4.

According to a fourth aspect of the invention there is provided an aqueous alkaline zinc or zinc alloy bath medium for depositing zinc or zinc alloys comprising a source of zinc ions and, in the case of the alloy, a source of additional metal ions of the alloying metals, a suitable chelating agent to render the ions soluble and a functional amount of the additive of the first, second or third aspect of the invention.

Preferably, the alloying metal is selected from iron, cobalt, nickel and manganese.

In preferred forms the zinc is present in an amount of from 2 g/l to 50 g/l (expressed as zinc metal).

The alkalinity of the bath medium is preferably provided by sodium hydroxide or potassium hydroxide in an amount of 10 to 300 g/l.

In preferred bath media the additive of the first or second aspect of the invention is present in an amount of 0.01 g/l to 20 g/l, preferably 0.1 g/l to 10 g/l and especially 0.2 g/l to 5 g/l.

Preferred bath media desirably comprise an effective amount of one or more further additive components selected from one or more of the groups comprising A: silicates, tartates, gluconates, heptonates and other hydroxy acids B: N-benzyl niacin, and/or aromatic aldehydes and their bisulphite adducts soluble in the bath medium C: amine/epihalohydrin polymers, especially imidazole/epihalohydrin polymers.

A fifth aspect of the present invention provides a process for electrodepositing zinc or zinc alloys on a conductive substrate, which process includes the step of contacting the substrate with the bath medium of the fourth aspect of the invention.

Preferably the substrate is selected from aluminium and its alloys, ferrous substrates, magnesium and its alloys, copper and its alloys, nickel and its alloys and zinc and its alloys.

Particularly preferably, the substrate is steel, especially mild steel.

A sixth aspect of the invention provides a plated article prepared by the process of the fourth aspect of the invention.

A seventh aspect of the invention relates to the use of a polymer as defined in the first, second or third aspects of the invention as an additive in an aqueous alkaline zinc or zinc alloy bath medium for electrodepositing zinc or zinc alloy.

An eighth aspect of the invention provides a random co-polymer having the general formula

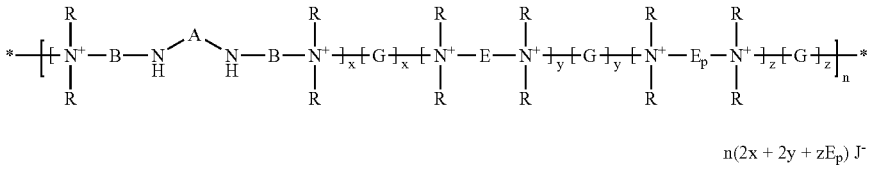

where $0<x\leqq 1$, $0\leqq y<1$, $0\leqq z<1$ and $x+y+z=1$, n is at least 2, A, B, R, $E_p$ and J are as hereinabove defined, G represents $G_u$ or $G_s$ as hereinabove defined and E represents $E_u$ or $E_s$ as hereinabove defined, provided that if neither $E_u$ nor $E_p$ is present, $G_u$ must be present.

The following examples are illustrative of preparation techniques for polymers according to the invention. NB: In these examples, 100% completion of the reaction may not be achievable or necessary and the reflux time may be varied accordingly.

EXAMPLE 1

N,N'-Bis[3-(dimethylamino)propyl]urea (35 grams), N,N,N',N'-tetramethyl-1,4-phenylenediamine (15 grams), water (34 grams) and ethanol (47 grams) are introduced into a reaction flask equipped with a reflux condenser, thermometer and stirrer. The reagents are stirred and heated to reflux. 1,4-dichlorobutane (31 grams) is added slowly over 1.5 hours. The mixture is refluxed for 9 hours at 80–85° C. The resulting liquid is allowed to cool to room temperature giving an aqueous solution of the desired product.

EXAMPLE 2

N,N'-Bis[3-(dimethylamino)propyl]urea (36 grams), 3,3'-imino-bis-(N,N-dimethylaminopropylamine) (17.6 grams), and water (103 grams) are introduced into a reaction flask equipped with a reflux condenser, thermometer and stirrer. The reagents are stirred and heated to reflux. 1,4-dichlorobutane (31.8 grams) is added over 0.5 hours and the mixture is refluxed for a further 1.5 hours. Benzyl chloride (11.9 grams) is then added over 0.5 hours and the mixture is refluxed for a further hour. Sodium hydroxide (3.8 grams) is then added as a 50% solution. A further addition of benzyl chloride (5.9 grams) is then added over 0.5 hours and the mixture is refluxed for a further 2 hours. The resulting liquid is allowed to cool to room temperature giving an aqueous solution of the desired product.

EXAMPLE 3

N,N'-Bis[3-(dimethylamino)propyl]urea (36 grams), 3,3'-imino-bis-(N,N-dimethylaminopropylamine) (17.6 grams), and water (96 grams) are introduced into a reaction flask equipped with a reflux condenser, thermometer and stirrer. The reagents are stirred and heated to reflux. 1,4-dichlorobutane (31.8 grams) is then added over 0.5 hours and the mixture is refluxed for a further 1.5 hours. Allyl chloride (7.2 grams) is then added over 0.5 hours and the mixture is refluxed for a further hour. Sodium hydroxide (3.8 grams) is then added as a 50% solution. A farther addition of allyl chloride (3.6 grams) is then added over 0.5 hours and the mixture is refluxed for a further 2 hours. The resulting liquid is allowed to cool to room temperature giving an aqueous solution of the desired product.

EXAMPLE 4

N,N'-Bis[3-(dimethylamino)propyl]urea (80.5 grams), N,N, N',N'-tetramethyl-1,6-hexanediamine (36.1 grams), and water (186.6 grams) are introduced into to a reaction flask equipped with a reflux condenser, thermometer and stirrer. 1,4-dichlorobutene (70 grams) is then added over 1 hour. The mixture is then refluxed for a further 4 hours. The resulting liquid is allowed to cool to room temperature giving an aqueous solution of the desired product.

EXAMPLE 5

N,N'-Bis[3-(dimethylamino)propyl]urea (36 grams), 3,3'-imino-bis-(N,N-dimethylaminopropylamine) (17.6 grams), and water (99 grams) are introduced into a reaction flask equipped with a reflux condenser, thermometer and stirrer. The reagents are stirred and heated to reflux. Bis-(2-chloroethyl) ether (35.8 grams) is then added over 1 hour and the mixture is refluxed for a further 1.5 hours. Allyl chloride (7.2 grams) is then added over 0.5 hours and the mixture is refluxed for a further hour. Sodium hydroxide (3.8 grams) is then added as a 50% solution. A further addition of allyl chloride (3.6 grams) is then added over 0.5 hours and the mixture is refluxed for a further 2 hours. The resulting liquid is allowed to cool to room temperature giving an aqueous solution of the desired product.

EXAMPLE 6

N,N'-Bis[3-(dimethylamino)propyl]urea (21.6 grams), 3,3'-imino-bis-(N,N-dimethylaminopropylamine) (29.2 grams), and water (104.5 grams) are introduced into a reaction flask equipped with a reflux condenser, thermometer and stirrer. The reagents are stirred and heated to reflux. Bis-(2-chloroethyl) ether (35.8 grams) is then added over 1 hour and the mixture is refluxed for a further 1.5 hours. Allyl chloride (11.9 grams) is then added over 0.5 hours and the mixture is refluxed for a further hour. Sodium hydroxide (6.2 grams) is then added as a 50% solution. A further addition of allyl chloride (6.0 grams) is then added over 0.5 hours and the mixture is refluxed for a further 2 hours. The resulting liquid is allowed to cool to room temperature giving an aqueous solution of the desired product.

EXAMPLE 7

N,N'-Bis[3-(dimethylamino)propyl]urea (36 grams), 3,3'-imino-bis-(N,N-dimethylaminopropylamine) (17.6 grams), and water (61 grams) are introduced into a reaction flask equipped with a reflux condenser, thermometer and stirrer. The reagents are stirred and heated to reflux. 1,4-dichlorobutane (31.8 grams) is added over 1 hour and the mixture is refluxed for a further 2 hours. Allyl glycidyl ether (10.7 grams) is then added over 0.5 hours and the mixture is refluxed for a further 2 hours. The resulting liquid is allowed to cool to room temperature giving an aqueous solution of the desired product.

The products of EXAMPLE 1, EXAMPLE 3, EXAMPLE 5 and EXAMPLE 7 are preferred embodiments of the present invention.

Two examples of fully saturated polymers used for comparison purposes are also given below;

COMPARATIVE EXAMPLE 1

N,N'-Bis[3-(dimethylamino)propyl]urea (36 grams), 3,3'-imino-bis-(N,N-dimethylaminopropylamine) (17.6 grams), and water (80 grams) are introduced into a reaction flask equipped with a reflux condenser, thermometer and stirrer. The reagents are stirred and heated to reflux. 1,4-dichlorobutane (31.8 grams) is added over 1 hour and the mixture is refluxed for a further 2 hours. The resulting liquid is allowed to cool to room temperature giving an aqueous solution of the desired product.

COMPARATIVE EXAMPLE 2

N,N'-Bis[3-(dimethylamino)propyl]urea (36 grams), 3,3'-imino-bis-(N,N-dimethylaminopropylamine) (17.6 grams), and water (80 grams) are introduced into a reaction flask equipped with a reflux condenser, thermometer and stirrer. The reagents are stirred and heated to reflux. Bis (2-chloroethyl) ether (35.7 grams) is added over 1 hour and the mixture is refluxed for a further 2 hours. The resulting liquid is allowed to cool to room temperature giving an aqueous solution of the desired product.

The polymer additives according to the invention can provide excellent results in zinc or zinc alloy electroplating processes when used on their own. Further benefits may be obtained by combination of the polymer additive of the invention with known further additives, such as those indicated in the groups below:

| | |
|---|---|
| Group 1: | Polymers according to the invention |
| Group 2: | Additives selected from the following; silicate, tartrate, gluconate, heptonate or other hydroxy acids. |
| Group 3: | N-Benzyl niacin and/or bath soluble aromatic aldehydes and their bisulphite adducts. |
| Group 4: | Imidazole/epihalohydrin polymers or other amine/epihalohydrin polymers. |

Preferably, one compound from each group is present in the plating bath medium in an effective amount. Therefore bath formulations will normally comprise; zinc metal in the range 2–50 g/l and more preferably 5–20 g/l; one or more alloying metals such as, but not limited to, nickel, iron, cobalt, manganese in an amount ranging from, but not limited to, 0.005–10 g/l; sodium or potassium hydroxide in the range 10–300 g/l. Baths in commercial use also tend to absorb carbon dioxide from the atmosphere and therefore may contain varying amounts of sodium or potassium carbonate.

The polymers according to the invention are effective in concentrations from 0.01 to 20 g/l but are normally within the range 0.1 to 10 g/l and are most preferably in the range 0.2 to 5 g/l.

Additives described in Group 2, such as silicate, tartrate, gluconate, heptonate or other hydroxy acids are normally present in amounts ranging from, but not limited to, 1–100 g/l and more preferably 20–80 g/l.

Group 3 additives such as N-benzyl niacin and bath soluble aromatic aldehydes (and their bisulphite adducts) are normally present in amounts ranging from, but not limited to, 1 to 500 mg/l and more preferably 5–100 mg/l.

Group 4 additives (imidazole/epihalohydrin polymers or other amine/epihalohydrin polymers) are normally present in amounts ranging from, but not limited to, 0.01 to 20 g/l, and are normally within the range 0.1 to 10 g/l.

The baths are normally operated in the range 0 to 60° C. but are more preferably in the range 20–35° C.

The following examples are illustrative of zinc and zinc alloy electroplating media and processes employing the polymer additives of the present invention. The following examples relate to electrodepostion experiments which were performed on mild steels, i.e. a ferrous based substrate. However, the procedures described in these examples are equally suitable for electrodeposition onto aluminium and its alloys, magnesium and its alloys, copper and its alloys, nickel and its alloys, and zinc and its alloys.

EXAMPLE A

An aqueous electrolyte suitable for plating zinc was prepared containing 12 g/l zinc (as metal) and 135 g/l NaOH. A Hull cell test was performed on this electrolyte at 1A for 10 minutes at a temperature of 25° C. The resultant deposit was black and powdery and was not suitable for commercial use. 3 ml/l of the product formed in example 1 was added to the electrolyte. A 1A Hull cell test now gave a semi-bright deposit of zinc at current densities of 0.5 to 15 A/dm$^2$.

EXAMPLE B

An aqueous electrolyte suitable for plating zinc was prepared containing 12 g/l zinc (as metal) and 135 g/l NaOH. 3 ml/l of the product of example 2 was added and a Hull cell test was performed at 1A for 10 minutes at a temperature of 25° C. A semi-bright deposit was formed at current densities of 1 to 15 A/dm$^2$.

EXAMPLE C

An aqueous electrolyte suitable for plating zinc was prepared containing 12 g/l zinc (as metal) and 135 g/l NaOH. 3 mill of the product of example 3 was added and a Hull cell test was performed at 1A for 10 minutes at a temperature of 25° C. A semi-bright deposit was formed at current densities of 1 to 15 A/dm2.

EXAMPLE D

An aqueous electrolyte suitable for plating zinc was prepared containing 12 g/l zinc (as metal) and 135 g/l NaOH. 3 ml/l of the product of example 4 was added and a Hull cell test was performed at 1A for 10 minutes at a temperature of 25° C. A semi-bright deposit was formed at current densities of 1 to 4 A/dm$^2$.

EXAMPLE E

An aqueous electrolyte suitable for plating zinc was prepared containing 12 g/l zinc (as metal) and 135 g/l NaOH. 2 ml/l of the product of example 5 was added and a Hull cell test was performed at 1A for 10 minutes at a temperature of 25° C. A semi-bright deposit was formed at current densities of 1 to 15 A/dm$^2$.

EXAMPLE F

An aqueous electrolyte suitable for plating zinc was prepared containing 12 g/l zinc (as metal) and 135 g/l NaOH. 2 ml/l of the product of example 7 was added and a Hull cell test was performed at 1A for 10 minutes at a temperature of 25° C. A semi-bright deposit was formed at current densities of 1 15 A/dm$^2$.

EXAMPLE G

An aqueous electrolyte suitable for plating zinc was prepared containing 12 g/l zinc (as metal) and 135 g/l NaOH. 3 ml/l of the product of example 6 was added and a Hull cell test was performed at 1A for 10 minutes at a temperature of 25° C. A semi-bright deposit was formed at current densities of 2 to 15 A/dm$^2$.

EXAMPLE H

An aqueous electrolyte suitable for plating zinc was prepared containing 12 g/l zinc (as metal) and 135 g/l NaOH. 3 ml/l of the product of example 1, 0.5 ml/l of an imidazole/epichlorohydrin polymer (Lugalvan ES 9572 from BASF), 0.02 g/l of N-benzyl niacin and 8 g/l of sodium silicate was added to the electrolyte. A 1 amp, 10 minute Hull cell test performed on this electrolyte at 25° C. produced a fully bright lustrous deposit over the entire current density range of the Hull cell panel. The thickness of the deposit obtained on this panel was measured using X-Ray Fluorescence and the deposit thickness at 2 A/dm$^2$ was 10% greater, and at 4 A/dm$^2$ was 12% greater, than that obtained from a comparative panel produced from an electrolyte prepared as above but substituting an equivalent concentration of Mirapol WT (a polymer as described in U.S. Pat. No. 5,435,898) for the product of example 1.

EXAMPLE I

An aqueous electrolyte suitable for plating zinc was prepared containing 12 g/l zinc (as metal) and 135 g/l NaOH. 3 ml/l of the product of example 2, 0.5 ml/l of an imidazole/epicholohydrin polymer (Lugalvan ES 9572), 0.02 g/l of N-benzyl niacin and 1 g/l of sodium potassium tartrate was added to the electrolyte. A 1 amp, 10 minute Hull cell test performed on this electrolyte at 25° C. produced a fully bright lustrous deposit over the entire current density range of the Hull cell panel. The thickness of the deposit obtained on this panel was measured using X-Ray Fluorescence and the deposit thickness at 2 A/dm$^2$ was 34% greater, and at 4 A/dm$^2$ was 56% greater, than that obtained from a comparative panel produced from an electrolyte prepared as above but substituting an equivalent concentration of Mirapol WT for the product of example 2.

EXAMPLE J

An aqueous electrolyte suitable for plating zinc was prepared containing 12 g/l zinc (as metal) and 135 g/l NaOH. 3 ml/l of the product of example 3, 0.5 ml/l of an imidazole/epichlorohydrin polymer (Lugalvan ES 9572), 0.02 g/l of N-benzyl niacin and 8 g/l of sodium silicate was added to the electrolyte. A 1 amp, 10 minute Hull cell test performed on this electrolyte at 25° C. produced a fully bright lustrous deposit over the entire current density range of the panel. The thickness of the deposit obtained on this panel was measured using X-Ray Fluorescence and the deposit thickness at 2 A/dm$^2$ was 20% greater, and at 4 A/dm$^2$ was 40% greater, than that obtained from a comparative panel produced from an electrolyte prepared as above but substituting an equivalent concentration of Mirapol WT for the product of example 3.

EXAMPLE K

An aqueous electrolyte suitable for plating zinc was prepared containing 12 g/l zinc (as metal) and 135 g/l NaOH. 3 ml/l of the product of example 4, 0.5 ml/l of an imidazole/epicholohydrin polymer (Lugalvan ES 9572), 0.02 g/l of N-benzyl niacin and 1 g/l of sodium potassium tartrate was added to the electrolyte. A 1 amp, 10 minute Hull cell test performed on this electrolyte at 25° C. produced a fully bright lustrous deposit over the current density range of 0.4 to 5 A/dm$^2$.

EXAMPLE L

An aqueous electrolyte suitable for plating zinc was prepared containing 12 g/l zinc (as metal) and 135 g/l NaOH. 2 ml/l of the product of example 5, 0.5 ml/l of an imidazole/epicholohydrin polymer (Lugalvan ES 9572), 0.02 g/l of N-benzyl niacin and 1 g/l of sodium potassium tartrate was added to the electrolyte. A 1 amp, 10 minute Hull cell test performed on this electrolyte at 25° C. produced a fully bright lustrous deposit over the entire current density range of the Hull cell panel. The thickness of the deposit obtained on this panel was measured using X-Ray Fluorescence and the deposit thickness at 2 A/dm$^2$ was 16% greater, and at 4 A/dm$^2$ was 33% greater, than that obtained from a comparative panel produced from an electrolyte prepared as above but substituting an equivalent concentration of Mirapol WT for the product of Example 5.

EXAMPLE M

An aqueous electrolyte suitable for plating zinc was prepared containing 12 g/l zinc (as metal) and 135 g/l NaOH. 3 ml/l of the product of Example 6, 0.5 ml/l of an imidazole/epicholohydrin polymer (Lugalvan ES 9572), 0.02 g/l of N-benzyl niacin and 1 g/l of sodium potassium tartrate was added to the electrolyte. A 1 amp, 10 minute Hull cell test performed on this electrolyte at 25° C. produced a fully bright lustrous deposit over the entire current density range of the Hull cell panel.

EXAMPLE N

An aqueous electrolyte suitable for plating zinc was prepared containing 12g/l zinc (as metal) and 135 g/l NaOH. 3 ml/l of the product of Example 7, 0.5 ml/l of an imidazole/epichlorohydrin polymer (Lugalvan ES 9572 from BASF), 0.02 g/l of N-benzyl niacin and 8 g/l of sodium silicate was added to the electrolyte. A 1 amp, 10 minute Hull cell test performed on this electrolyte at 25° C. produced a fully bright lustrous deposit over the entire current density range of the Hull cell panel. The thickness of the deposit obtained on this panel was measured using X-Ray Fluorescence and the deposit thickness at 2 A/dm$^2$ was 17% greater, and at 4 A/dm$^2$ was 35% greater, than that obtained from a comparative panel produced from an electrolyte prepared as above but substituting an equivalent concentration of Mirapol WT (a polymer as described in U.S. Pat. No. 5,435,898) for the product of Example 7.

EXAMPLE O

An aqueous electrolyte suitable for plating a zinc/iron alloy was prepared containing 12 g/l zinc (as metal), 135 g/l NaOH, 60 g/l sodium heptonate and 100 mg/l of iron. 3 ml/l of the product of example 2, 0.5 ml/l of an imidazole/epichlorohydrin polymer (Lugalvan ES 9572) and 0.02 g/l of N-benzyl niacin was added to the electrolyte. A 1 amp, 10 minute Hull cell test performed on this electrolyte at 25° C. produced a fully bright lustrous deposit over the entire current density range of the Hull cell panel. Passivation of the Hull cell panel in a chromating bath containing chromic acid, sulphuric acid, phosphoric acid and other inorganic salts produced a uniform black coating thus indicating uniform co-deposition of iron over the Hull cell panel.

EXAMPLE P

An aqueous electrolyte suitable for plating a zinc/cobalt/iron alloy was prepared containing 12 g/l zinc (as metal), 135 g/l NaOH, 60 g/l sodium heptonate and 50 mg/l of iron and 80 mg/l cobalt. 3 ml/l of the product of example 2, 0.5 ml/l of an imidazole/epichlorohydrin polymer (Lugalvan ES 9572) and 0.02 g/l of N-benzyl niacin was added to the electrolyte. A 1 amp, 10 minute Hull cell test performed on this electrolyte at 25° C. produced a fully bright lustrous deposit over the entire current density range of the Hull cell panel. Passivation of the Hull cell panel in a chromating bath containing chromic acid, sulphuric acid, phosphoric acid and other inorganic salts produced a uniform black coating thus indicating uniform co-deposition of cobalt and iron over the Hull cell panel. Subsequent analysis of the deposit by energy dispersive X-ray analysis showed a cobalt concentration of 0.4% over a wide range of current densities.

EXAMPLE Q

An aqueous electrolyte suitable for plating zinc was prepared containing 12 g/l zinc (as metal) and 135 g/l NaOH. 3 ml/l of the product of example 3, 0.5 ml/l of an imidazole/epichlorohydrin polymer (Lugalvan ES 9572) 0:1 g/l of veratraldehyde (3,4-dimethoxybenzaldehyde) and 1 g/l of sodium potassium tartrate was added to the electrolyte. A 1 amp, 10 minute Hull cell test performed on this electrolyte at 25° C. produced a bright but slightly hazy deposit over the entire current density range of the Hull cell panel.

EXAMPLE R

An aqueous electrolyte suitable for plating zinc was prepared containing 12 g/l zinc (as metal) and 135 g/l NaOH. 1.5 ml/l of the product of example 1, 1.0 ml/l of an amine/epichlorohydrin polymer, 0.02 g/l of N-benzyl niacin and 8 g/l of sodium silicate was added to the electrolyte. A 4 amp, 45 minute Hull cell test was performed on this electrolyte at 25° C. and after plating the panel was passivated in a chromating bath containing chromic sulfate, hydrofluoric acid, nitric acid and other inorganic salts and then dried. The test produced a bright deposit over the entire current density range of the Hull cell panel, and after standing for 2 months the deposit was free from blistering.

EXAMPLE S

An aqueous electrolyte suitable for plating zinc was prepared containing 12 g/l zinc (as metal) and 135 g/l NaOH. 1.5 ml/l of the product of example 7, 1.0 ml/l of an amine/epichlorohydrin polymer, 0.01 g/l of N-benzyl niacin, 0.02 g/l of vanillin and 8 g/l of sodium silicate was added to the electrolyte. A 4 amp, 45 minute Hull cell test was performed on this electrolyte at 25° C. and after plating the panel was passivated in a chromating bath containing chromic sulfate, hydrofluoric acid, nitric acid and other inorganic salts and then dried. The test produced a bright deposit over the entire current density range of the Hull cell panel, and after standing for 2 months the deposit was free from blistering. In an equivalent test substituting the product of comparative example 1 for the product of example 7, after 3 days blisters were evident on the test panel. In an equivalent test substituting the product of comparative example 2 for the product of example 7 after standing for 2 months the deposit was free from blistering but the deposit had reduced brightness. In an equivalent test substituting Mirapol WT for the product of example 7, after standing for 2 months the deposit was free from blistering but the deposit had reduced brightness and reduced thickness.

EXAMPLE T

An aqueous electrolyte suitable for plating zinc was prepared containing 12 g/l zinc (as metal) and 135 g/l NaOH. 1.0 ml/l of the product of example 1, 1.0 ml/l of an amine/epichlorohydrin polymer, 0.02 g/l of N-benzyl niacin and 8 g/l of sodium silicate was added to the electrolyte. A steel article was plated in the electrolyte at an average cathode current density of 2.5 A/dm$^2$ for 30 minutes at a temperature of 25° C. After plating, the article was passivated in a chromating bath containing chromic sulfate, hydrofluoric acid, nitric acid and other inorganic salts and then dried. The article was plated all over in a bright and lustrous zinc deposit and after standing for 2 months the deposit was free from blistering.

EXAMPLE U

An aqueous electrolyte suitable for plating zinc was prepared containing 13 g/l zinc (as metal) and 130 g/l NaOH. 3.0 ml/l of the product of example 1, 1.0 ml/l of an amine/epichlorohydrin polymer, 0.015 g/l of N-benzyl niacin and 8 g/l of sodium silicate was added to the electrolyte. A steel article was plated in the electrolyte at an average cathode current density of 2.5 A/dm$^2$ for 1 hour at a temperature of 25° C. After plating, the article was passivated in a chromating bath containing chromic acid, sulphuric acid, nitric acid and other inorganic salts and then dried. The article was plated all over in a lustrous zinc deposit and after standing for 10 months the deposit was free from blistering. Deformation of the part demonstrated that the adhesion of the deposit was excellent.

EXAMPLE V

An aqueous electrolyte suitable for plating zinc was prepared containing 12 g/l zinc (as metal) and 135 g/l NaOH. 1.5 ml/l of the product of example 3, 1.0 ml/l of an amine/epichlorohydrin polymer, 0.02 g/l of N-benzyl niacin and 8 g/l of sodium silicate was added to the electrolyte. A steel article was plated in the electrolyte at an average cathode current density of 2.5 A/dm$^2$ for 40 minutes at a temperature of 25° C. After plating, the article was passivated in a chromating bath containing chromic sulfate, hydrofluoric acid, nitric acid and other inorganic salts and then dried. The article was plated all over in a lustrous zinc deposit and after standing for 2 months the deposit was free from blistering.

EXAMPLE W

An aqueous electrolyte suitable for plating zinc was prepared containing 12 g/l zinc (as metal) and 135 g/l NaOH. 1.5 ml/l of the product of example 1, 1.0 ml/l of an amine/epichlorohydrin polymer, 0.02 g/l of N-benzyl niacin and 8 g/l of sodium silicate was added to the electrolyte. A steel panel abraded to a standard roughness was plated in the electrolyte at an average cathode current density of 2.5 A/dm$^2$ for 60 minutes at a temperature of 25° C. After plating, the panel was passivated in a chromating bath containing chromic sulfate, hydrofluoric acid, nitric acid and other inorganic salts and then dried. The deposit thickness was 27 μm (as measured by X-Ray fluorescence). The surface roughness of the panel was analysed prior to, and after plating by a laser interferometry technique and the result quoted as the mean deviation of the surface profile from the centre line (Ra). Prior to plating the surface roughness was measured as Ra=1.10 μm and after plating the surface roughness was Ra=0.64 μm. A comparative panel produced from an electrolyte prepared as above but substituting an equivalent concentration of Mirapol WT for the product of example 1 produced Ra=1.10 prior to plating and Ra=1.00 after plating.

EXAMPLE X

An aqueous electrolyte suitable for plating zinc was prepared containing 12 g/l zinc (as metal) and 135 g/l NaOH. 1.5 ml/l of the product of example 3, 1.0 ml/l of an amine/epichlorohydrin polymer, 0.02 g/l of N-benzyl niacin and 8 g/l of sodium silicate was added to the electrolyte. A steel panel abraded to a standard roughness was plated in the electrolyte at an average cathode current density of 2.5 A/dm$^2$ for 55 minutes at a temperature of 25° C. After plating, the panel was passivated in a chromating bath containing chromic sulfate, hydrofluoric acid, nitric acid and other inorganic salts and then dried. The deposit thickness was 25 μm (measured by X-Ray fluorescence). The surface roughness of the panel (measured by laser interferometry) was Ra=1.10 μm before plating and Ra=0.71 μm after plating.

The invention claimed is:

1. An additive for an alkaline zinc or zinc alloy electroplating bath medium, the additive comprising a random co-polymer comprising:

a reaction product of:

(i) one or more di-tertiary amines including an amide or thioamide functional group, and (ii) one or more second di-tertiary amines including an unsaturated moiety, with (iii) one or more first linking agents capable of reacting with said amines (i) and (ii).

2. An additive as claimed in claim 1 wherein the first linking agent includes an unsaturated moiety.

3. An additive as claimed in claim 1 wherein the di-tertiary amine including the amide or thioamide functional group has the general formula:

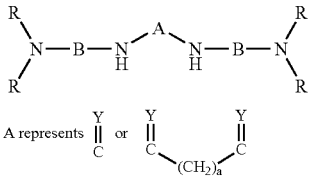

where A represents 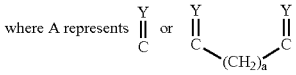

and wherein Y=O or S, a is an integer from 2 to 6, B represents a lower alkyl group and R represents a methyl, ethyl, isopropyl, n-propyl or hydroxyethyl group and each R may be the same or different.

4. An additive as claimed in claim 1 wherein the second di-tertiary amine including the unsaturated moiety has the general formula

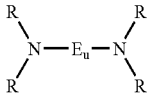

where R represents a methyl, ethyl, isopropyl, n-propyl or hydroxyethyl group and each R may be the same or different and $E_u$ represents the unsaturated moiety.

5. An additive as claimed in claim 4 wherein $E_u$ is selected from groups of the general formula

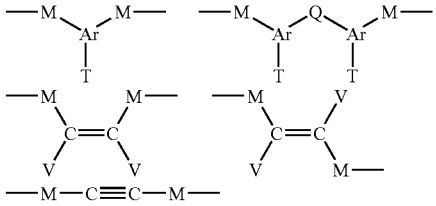

where M may be absent or is a straight chain, branched or cyclic $C_1$–$C_8$ alkyl group and each M may be the same or different V is hydrogen or a lower alkyl and each V may be the same or different, Ar represents an aromatic or heteroaromatic nucleus, T represents one or more substituents or hydrogen on the aromatic nucleus and Q may be absent or is a link group selected from ether, thioether, carbonyl, thione, secondary amine, sulfone or sulfoxide, or a straight chain branched or cyclic $C_1$–$C_{12}$ alkyl group which may optionally contain in the alkyl chain one or more groups selected from ether, thioether, carbonyl, thione, alcohol, thiol, secondary amine, sultana and sulfoxide.

6. An additive as claimed in claim 5 wherein $E_u$ is selected from groups of the general formula

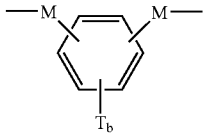

-continued

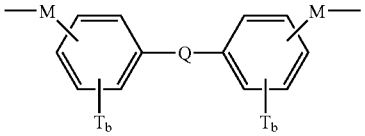

where M may be absent or is a straight chain, branched or cyclic $C_1$–$C_8$ alkyl group and each M may be the same or different, Q may be absent or is a link group selected from ether, thioether, carbonyl, thione, secondary amine, sulfone or sulfoxide, or a straight chain branched or cyclic $C_1$–$C_{12}$ alkyl group which may optionally contain in the alkyl chain one or more groups selected from ether, thioether, carbonyl, thione, alcohol, thiol, secondary amine, sulfone and sulfoxide, and T represents one or more substituents or hydrogen on the aromatic nucleus, b represents the number of substituents T on the aromatic nucleus.

7. An additive as claimed in claim 5 wherein Ar represents a 5 or 6 membered aromatic nucleus optionally including one or more atoms selected (ruin the group consisting of O,S,N, and combinations of the foregoing.

8. An additive as claimed in claim 4 wherein $E_u$ is selected from groups of the general formula

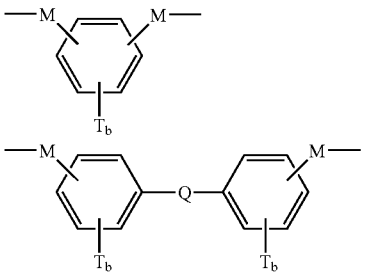

where M may be absent or is a straight chain, branched or cyclic $C_1$–$C_8$ alkyl group and each M may be the same or different, Q may be absent or is a link group selected from ether, thioether, carbonyl, thione, secondary amine, sulfone or sulfoxide, or a straight chain branched or cyclic $C_1$–$C_{12}$ alkyl group which may optionally contain in the alkyl chain one or more groups selected from ether, tioether, carbonyl, thione, alcohol, thiol, secondary amine, sulfone and sulfoxide, and T represents one or more substituents or hydrogen on the aromatic nucleus, and b represents the number of substituents T on the aromatic nucleus.

9. An additive as claimed in claim 1 wherein the second di-tertiary amine, where saturated, has the general formula

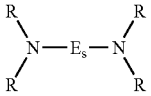

where R represents a methyl, ethyl, isopropyl, n-propyl or hydroxyethyl group and each R may be the same or different and $E_s$ represents a straight chain, branched or cyclic $C_1$–$C_8$ alkyl group which may optionally contain in the alkyl chain one or more groups selected from the group consisting of ethers, thioethers, carbonyls, thiones, alcohols, thiols, secondary, tertiary and quatemary amines, sulfones and sulfoxides.

10. An additive as claimed in claim 1 wherein the second di-tertiary amine, including the unsaturated moiety, has the general formula

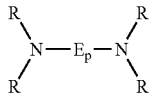

where R represents a methyl, ethyl, isopropyl, n-propyl or hydroxyethyl group and each R may be the same or different, $E_p$ has the general formula

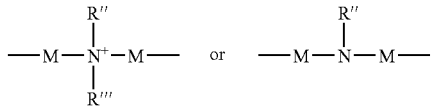

where M may be absent or is a straight chain, branched or cyclic $C_1$–$C_8$ alkyl group and each M may be the same or different, R''' may be H or the same as R'' or may represent a straight chain, branched or cyclic $C_1$–$C_8$ alkyl group, and R'' may be selected from

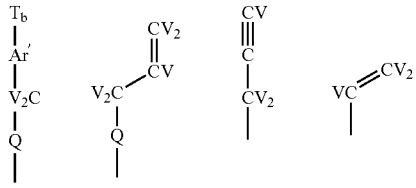

where V is hydrogen or a lower alkyl and each V may be the same or different, T represents one or more substituents or hydrogen on the aromatic nucleus, Q may be absent or is a link group selected from ether, thioether, carbonyl, thione, secondary amine, sulfone or sulfoxide, or a straight chain branched or cyclic $C_1$–$C_{12}$ alkyl group which may optionally contain in the alkyl chain one or more groups selected from ether, thioether, carbonyl, thione, alcohol, thiol, secondary amine, sulfone and sulfoxide, Ar' represents a 5 or 6 membered aromatic nucleus optionally including one or more O and/or S atoms, and b represents the number of substituents T on the aromatic nucleus.

11. An additive as claimed in claim 1 wherein the first linking agent has the general formula $$X\text{-}G_u\text{-}X$$

where X is selected from the group consisting of Cl, Br and I and $G_u$ represents an unsaturated moiety.

12. An additive as claimed in claim 11 wherein $G_u$ is selected from

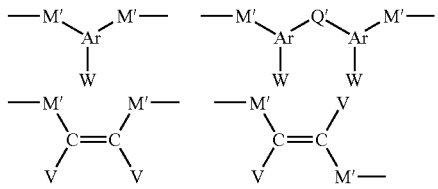

-continued $$—M'—C\equiv C—M'—$$

where V represents H or a lower alkyl group, M' is a straight chain, branched or cyclic $C_1$–$C_8$ alkyl group and each M' may be die same or different, Ar represents a 5 or 6 membered aromatic nucleus or a 5 or 6 membered hetero-aromatic nucleus including one or more hetero-atoms selected from S and O, W represents one or more substituents or hydrogen on the aromatic or hetero-aromatic nucleus and Q' is a link group selected from ether, thioether, carbonyl, thione, sulfone or sulfoxide or a straight chain, branched or cyclic $C_1$–$C_8$ alkyl group which may optionally contain in the alkyl chain one or more groups selected from ether, thioether, carbonyl, thione, alcohol, thiol, sulfone and sulfoxide.

13. An additive as claimed in claim 12 wherein $G_u$ is selected from

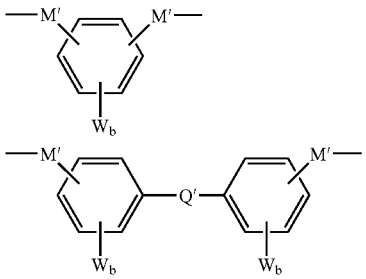

where W represents one or more substituents or hydrogen on the aromatic or hetero-aromatic nucleus, M' is a straight chain, branched or cyclic $C_1$–$C_8$ alkyl group and each M' may be the same or different, and O' is a link group selected from ether, thioether, carbonyl, thione, sulfone or sulfoxide or a straight chain, branched or cyclic $C_1$–$C_8$ alkyl group which may optionally contain in the alkyl chain one or more groups selected from ether, thioether, carbonyl, thione, alcohol, thiol, sulfone and sulfoxide, and b represents the number of substituents W on the aromatic nucleus.

14. An additive as claimed in claim 1 wherein the first linking agent has the general formula (6) below:

$$X\text{-}G_s\text{-}X \qquad (6)$$

where X represents Cl, Br or I, and $G_s$ represents a straight chain, branched or cyclic $C_1$–$C_8$ alkyl group which may optionally contain in the alkyl chain one or more groups selected from the group consisting of ethers, thioethers, carbonyls, thiones, alcohols, thiols, sulfones, and sulfoxides.

15. An additive as claimed in claim 1 wherein the linking agent is a halomethyloxirane compound.

16. An additive as claimed in claim 1 wherein the random co-polymer has the general formula

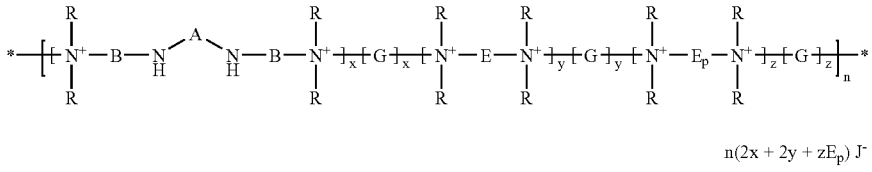

$n(2x + 2y + zE_p)\ J^-$ where $0<x\leqq 1$, $0<y\leqq 1$, $0\leqq z<1$ and $x+y+z=1$, n is at least 2, wherein A represents

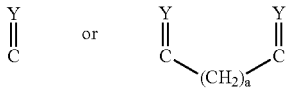

wherein Y=O or S, a is an integer from 2 to 6, B represents a lower alkyl group and R represents a methyl, ethyl, isopropyl, n-propyl or hydroxyethyl group and each R may be the same or different, J is a counter ion, G represents $G_u$, an unsaturated moiety, or $G_s$. a straight chain, branched or cyclic $C_1$–$C_8$ alkyl group which may optionally contain in the alkyl chain one or more groups selected from ether, thioether, carbonyl, thione, alcohol, thiol, sulfone, or sulfoxide, E represents $E_u$ or $E_s$, wherein $E_u$ is selected from groups of the general formula

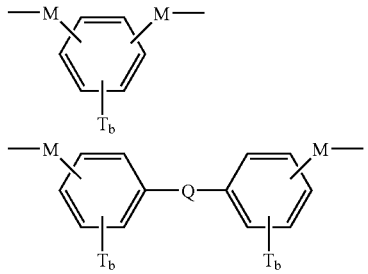

where M may be absent or is a straight chain, branched or cyclic $C_1$–$C_8$ alkyl group and each M may be the same or different, Q may be absent or is a link group selected from ether, thioether, carbonyl, thione, secondary amine, sulfone or sulfoxide, or a straight chain branched or cyclic $C_1$–$C_{12}$ alkyl group which may optionally contain in the alkyl chain one or more groups selected from ether, thioether, carbonyl, thione, alcohol, thiol, secondary amine, sulfone and sulfoxide, and T represents one or more substituents or hydrogen on the aromatic nucleus, and b represents the number of substituents T on the aromatic nucleus, and $E_s$ represents a straight chain, branched or cyclic $C_1$–$C_8$ alkyl group which may optionally contain in the alkyl chain one or more groups selected from: ether, thioether, carbonyl, thione, alcohol, thiol, secondary, tertiary or quatemary amine, sulfone and sulfoxide, and wherein $E_p$ has the general formula

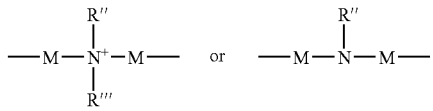

where M may be absent or is a straight chain, branched or cyclic $C_1$–$C_8$ alkyl group and each M may be the same or different, R''' may be H or the same as R'' or may represent a straight chain, branched or cyclic $C_1$–$C_8$ alkyl group, and R'' may be selected from

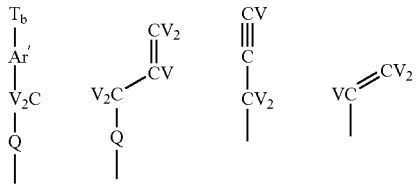

where V may be hydrogen or a lower alkyl and each V may be the same or different, T represents one or more substituents or hydrogen on the aromatic nucleus, Q may be absent or is a link group selected from ether, thioether, carbonyl, thione, secondary amine, sulfone or sulfoxide, or a straight chain branched or cyclic $C_1$–$C_{12}$ alkyl group which may optionally contain in the alkyl chain one or more groups selected from ether, thioether, carbonyl, thione, alcohol, thiol, secondary amine, sulfone and sulfoxide, Ar' represents a 5 or 6 membered aromatic nucleus optionally including one or more O and/or S atoms, and b represents the number of substituents T on the aromatic nucleus, provided that if neither $E_u$ nor $E_p$ is present, $G_u$ must be present.

17. An aqueous alkaline zinc or zinc alloy bath medium for depositing zinc or zinc alloys comprising a source of zinc ions and, in the case of the alloy, a source of additional metal ions of the alloy, a suitable chelating agent to render the ions soluble and a functional amount of an additive comprising a random co-polymer comprising:

a reaction product of:

(i) one or more di-tertiary amines including an amide or thioamide functional group, and (ii) one or more second di-tertiary amines including an unsaturated moiety, with (iii) one or more first linking agents capable of reacting with said amines (i) and (ii).

18. A bath medium as claimed in claim 17 wherein the alloying metal is selected from the group consisting of iron, cobalt, nickel and manganese.

19. A bath medium as claimed in claim 17 wherein the zinc ions are present in an amount of from 2 g/l to 50 g/l (expressed as zinc metal).

20. A bath medium as claimed in claim 17 wherein the alkalinity is provided by sodium hydroxide or potassium hydroxide in an amount of 10 to 300 g/l.

21. A bath medium as claimed in claim 17 wherein the additive is present in an amount of 0.01 g/l to 20 g/l.

22. A bath medium as claimed in claim 21 wherein the additive is present in an amount of 0.1 g/l to 10 g/l.

23. A bath medium as claimed in claim 22 wherein the additive is present in an amount of 0.2 g/l to 5 g/l.

24. A bath medium as claimed in claim 17 further comprising an effective amount of one or more further additive components selected from one or more of the groups consisting of:

(A) silicates, tartates, gluconates, heptonates and other hydroxy acids;

(B) N-benzyl niacin, and aromatic aldchydes and their bisulphite adducts soluble in die bath medium;

(C) amine/epihalodhydrin polymers.

25. A bath medium as claimed in claim 24 wherein said amine/epihalodhydrin polymers comprise imidazole/epihalohydrin polymers.

26. A process for electrodepositing zinc or zinc alloys on a conductive substrate, comprising contacting the substrate with an aqueous electrolyte comprising:

(a) a source of zinc ions and, in the case of the alloys, a source of additional metal ions of the alloys, (b) a suitable chelating agent to render the ions soluble; and (c) a functional amount of an additive comprising a random co-polymer comprising a reaction product of:

(i) one or more di-tertiary amines including an amide or thioamide functional group, and (ii) one or more second di-tertiary amines including an unsaturated moiety, with (iii) one or more first linking agents capable of reacting with said amines (i) and (ii);

for a period of time and at a suitable cathode current density and temperature to produce a plated deposit on the conductive substrate.

27. A process as claimed in claim 26 wherein the substrate is selected from the group consisting of aluminium and its alloys, ferrous substrates, magnesium and its alloys, copper and its alloys, nickel and its alloys, and zinc and its alloys.

28. A process as claimed in claim 27 wherein the substrate is steel.

29. A process as claimed in claim 28 wherein the substrate is mild steel.

* * * * *

UNITED STATES PATENT AND TRADEMARK OFFICE

CERTIFICATE OF CORRECTION

PATENT NO. : 7,109,375 B2
APPLICATION NO. : 10/333484
DATED : September 19, 2006
INVENTOR(S) : Roderick D. Herdman et al.

It is certified that error appears in the above-identified patent and that said Letters Patent is hereby corrected as shown below:

Column 1
Line 10, delete “2000” and replace it with --2001--

Column 20
Line 47, delete “different” and replace it with --different,--
Line 50, delete “sultana” and replace it with --sulfone--

Column 21
Line 23, delete “(ruin” and replace it with --from--
Line 46, delete “tioether” and replace it with --thioether--
Line 66, delete “quatemary” and replace it with --quaternary--

Column 23
Line 8, delete “die” and replace it with --the--

Column 24
Line 46, delete “quatemary” and replace it with --quaternary--

Column 26
Line 13, delete “aldchydes” and replace it with --aldehydes--

Signed and Sealed this

Nineteenth Day of December, 2006

JON W. DUDAS
*Director of the United States Patent and Trademark Office*